US007252520B1

(12) United States Patent
Millard et al.

(10) Patent No.: US 7,252,520 B1
(45) Date of Patent: Aug. 7, 2007

(54) FLEX FILM CARD EDGE CONNECTOR AND CABLE ASSEMBLY

(75) Inventors: Steven Jay Millard, Mechanicsburg, PA (US); Michael Warren Fogg, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/411,492

(22) Filed: Apr. 25, 2006

(51) Int. Cl.
*H01R 12/00* (2006.01)

(52) U.S. Cl. ..... 439/77

(58) Field of Classification Search ..... 439/67, 439/77, 496

See application file for complete search history.

(56) References Cited

U.S. PATENT DOCUMENTS 3,818,122 A * 6/1974 Luetzow ..... 174/86
4,026,011 A * 5/1977 Walton ..... 29/846
4,911,643 A * 3/1990 Perry et al. ..... 439/67
5,044,980 A * 9/1991 Krumme et al. ..... 439/496
5,564,931 A 10/1996 Fabian et al.
6,039,600 A 3/2000 Etters et al.
6,344,616 B1 * 2/2002 Yokokawa ..... 174/117 F
6,444,921 B1 * 9/2002 Wang et al. ..... 174/260
2006/0049500 A1 3/2006 Goodwin
2006/0050492 A1 3/2006 Goodwin et al.
2006/0053345 A1 3/2006 Goodwin

* cited by examiner

*Primary Examiner*—Chandrika Prasad
*Assistant Examiner*—Harshad C Patel

(57) ABSTRACT

A flex film card edge connector includes a substantially planar substrate having opposite major surfaces joined at an edge; and a flexible film wrapped around the edge and supported on both of the major surfaces. A first and second set of conductive pads are arrayed along the edges on one and the other of the major surfaces. The flexible film has a span that extends around the edge without any electrical connection between the first set of conductive pads and the second set of conductive pads. A flex film cable assembly includes a flexible film configured as an elongated strip having first and second ends, and the flex film card edge connector at least one of the ends. Methods of manufacturing both the flex film card edge connector and the flex film cable assembly are also disclosed.

2 Claims, 8 Drawing Sheets

FLEX FILM CARD EDGE CONNECTOR AND CABLE ASSEMBLY

BACKGROUND

1. Technical Field

The present disclosure relates to an electrical connector that provides a card edge interface for a flex film electrical circuit, and to a cable assembly using the connector.

2. Discussion of Related Art

A flex film electrical circuit comprises a flexible film substrate such as a polyimide sheet that has circuit traces etched thereon. The flex film circuit may be terminated to a card edge type electrical connector that permits the flex film circuit to be repeatedly connected to, and disconnected from, other electrical components.

In a standard flex film card edge connector, the flexible film having circuit traces thereon is sandwiched between a pair of rigid circuit board substrates each having conductive pads on respective outer surfaces thereof. The circuit board substrates have plated vias that electrically connect the circuit traces on the flex film to the conductive pads on the circuit boards. This structure provides a card edge interface for mating with a card edge receptacle connector.

A problem with the standard flex film card edge connector is that the rigid circuit boards generally contain embedded glass fibers which result in an abrasive surface that causes significant wear on mating contacts in the receptacle connector. Another problem is that the vias in the circuit boards must be drilled and plated in manufacturing steps that add to expense.

There is a need for a flexible film connector that overcomes these problems.

SUMMARY

The present disclosure relates to a flex film card edge connector that includes a substantially planar substrate having opposite major surfaces joined at an edge. A flexible film is wrapped around the edge and supported on both of the major surfaces. The flexible film has a first set of conductive pads arrayed along the edge on one of the major surfaces, and a second set of conductive pads arrayed along the edge on the other of the major surfaces, and a span that extends around the edge without any electrical connection between the first set of conductive pads and the second set of conductive pads.

The present disclosure relates also to a flex film cable assembly that includes a flexible film configured as an elongated strip having first and second ends, and a flex film card edge connector at least one of the ends. The flex film card edge connector includes a substantially planar substrate having opposite major surfaces joined at an edge, and the flexible film is wrapped around the edge and is supported on both of the major surfaces. The flexible film has a first set of conductive pads arrayed along the edge on one of the major surfaces, and a second set of conductive pads arrayed along the edge on the other of the major surfaces, and a span that extends around the edge without any electrical connection between the first set of conductive pads and the second set of conductive pads. The first set of conductive pads in one of the connectors is electrically connected to the first set of conductive pads in the other of the connectors by a first set of circuit traces on the flexible film, and the second set of conductive pads in the one connector is electrically connected to the second set of conductive pads in the other connector by a second set of circuit traces on the flexible film. The second end of the strip may be a free end. The flexible film may include polyimide. The substrate may include a glass-reinforced epoxy. The circuit traces may include a conductive printing or a copper tape.

In addition, the present disclosure relates to a method of manufacturing a flex film card edge connector including the steps of providing a flexible film and a substantially planar substrate having opposite major surfaces joined at an edge, and arraying a first set of conductive pads arrayed along the edge on one of the major surfaces and a second set of conductive pads along the edge on the other of the major surfaces. The method includes also wrapping the flexible film around the edge, and supporting the flexible film on both of the major surfaces, the flexible film having a span that extends around the edge without any electrical connection between the first set of conductive pads and the second set of conductive pads.

The method of manufacturing the flex film cable assembly may further include the steps of providing a flexible film configured as an elongated strip having first and second ends and at least one substantially planar substrate having opposite major surfaces joined at an edge, and arraying a first set of conductive pads along the edge on one of the major surfaces and a second set of conductive pads along the edge on the other of the major surfaces. The method may further include electrically connecting the first set of conductive pads in one of the connectors connected to the first set of conductive pads in the other of the connectors by a first set of circuit traces on the flexible film, electrically connecting the second set of conductive pads in the one connector to the second set of conductive pads in the other connector by a second set of circuit traces on the flexible film, wrapping the flexible film around the edge; and supporting the flexible film on both of the major surfaces, the flexible film having a span that extends around the edge without any electrical connection between the first set of conductive pads and the second set of conductive pads, to form a flex film card edge connector at the first end of the elongated strip. The second end of the elongated strip may be a free end.

The method of manufacturing the flex film cable assembly may further include the elongated strip being an elongated loop having first and second ends, and the step of providing is performed by providing at least two substantially planar substrates, with each substrate having opposite major surfaces joined at an edge, and the steps of arraying, wrapping and supporting are implemented to form at least two flex film card edge connectors joined at a joint such that each of the at least two flex film card edge connectors has a span that extends around the edge without any electrical connection between the first set of conductive pads and the second set of conductive pads.

The method of manufacturing the flex film cable assembly may further include the steps of separating the at least two flex film card edge connectors at the joint, and moving one of the at least two flex film card edge connectors with respect to another one of the at least two flex film card edge connectors to form the cable assembly.

DETAILED DESCRIPTION

Figure 1:
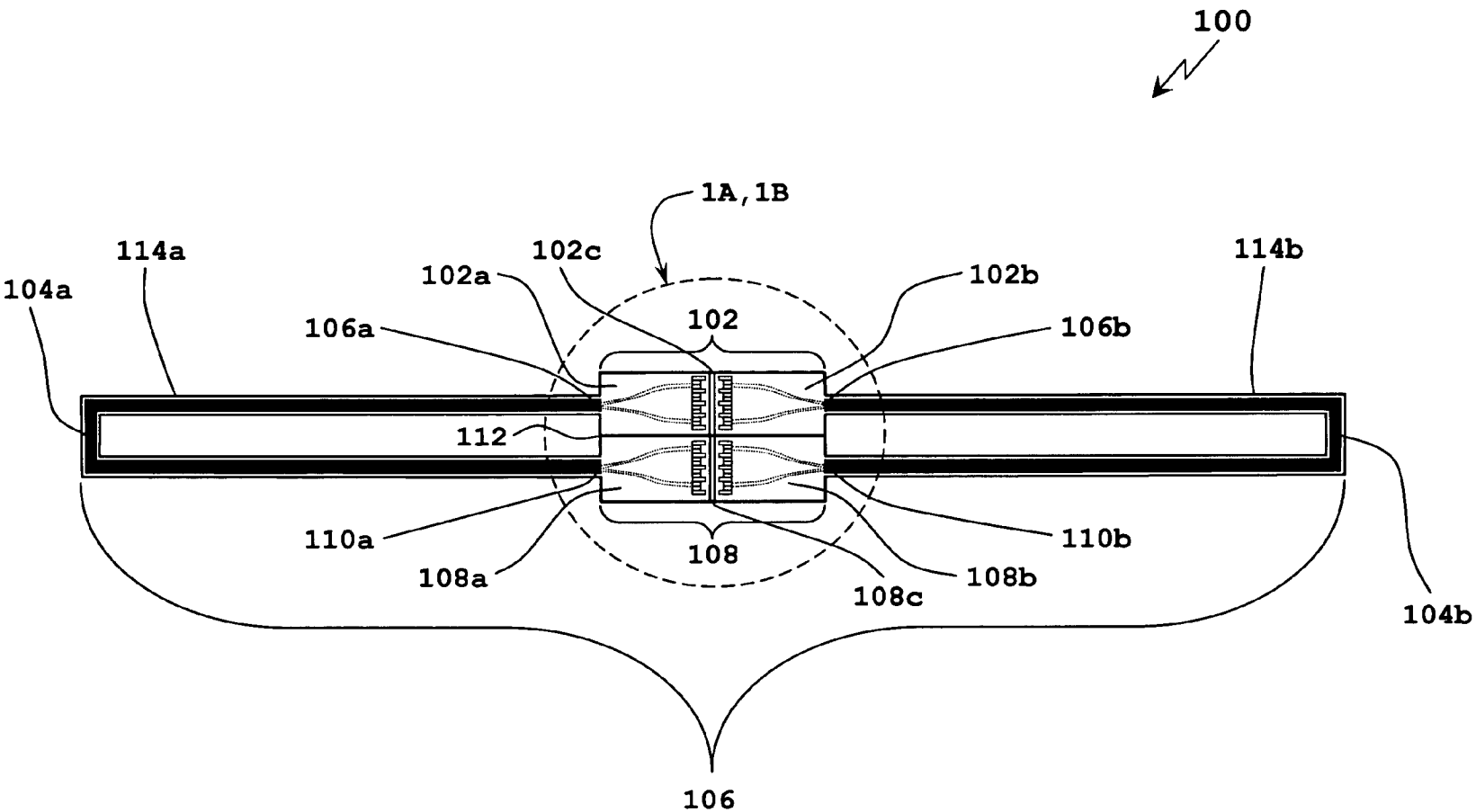
FIG. 1 is a plan view of a flex film cable assembly prior to final manufacturing according to the present disclosure.

The present disclosure will be understood more fully from the detailed description given below and from the accompanying drawings of particular embodiments of the disclosure which, however, should not be taken to limit the disclosure to a specific embodiment but are for explanatory purposes.

Numerous specific details may be set forth herein to provide a thorough understanding of a number of possible embodiments of the present disclosure. It will be understood by those skilled in the art, however, that the embodiments may be practiced without these specific details. In other instances, well-known methods, procedures, components and circuits have not been described in detail so as not to obscure the embodiments. It can be appreciated that the specific structural and functional details disclosed herein may be representative and do not necessarily limit the scope of the embodiments.

Some embodiments may be described using the expression "coupled" and "connected" along with their derivatives. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments disclosed herein are not necessarily limited in this context.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Embodiments of the present disclosure will now be described in detail with reference to the drawing figures wherein like reference numerals identify similar or identical elements. As may be used herein and as is traditional, the term "distal" refers to that portion which is furthest from the user while the term "proximal" refers to that portion which is closest to the user. In addition, terms such as "above", "below", "forward", "rearward", etc. refer to the orientation of the figures or the direction of components and are simply used for convenience of description.

Referring to FIGS. 1-5, a flex film cable assembly according to an embodiment of the present disclosure is generally designated as 100. As best shown in FIG. 1, prior to final assembly, the flex film cable assembly 100 includes a flexible film 106 having a first or outer side 117 and a second or inner side 119 (see FIG. 2). The flexible film 106 may be made from a flexible material such as polyimide (sold under the trade name Kapton® by DuPont High Performance Materials, Circleville, Ohio, USA). As used herein, the flexible film 106 is defined as a flexible board which includes wiring connectors or circuit traces extending from and/or upon a surface of the film.

The flexible film 106 has first and second generally U-shaped cable trace portions 114*a* and 114*b*, each having first and second ends 106*a*, 110*a* and first and second ends 106*b*, 110*b*, respectively. The generally U-shaped cable trace portions 114*a* and 114*b* are formed as elongated loops. Also referring to FIG. 1A, the U-shaped cable trace portions 114*a* and 114*b* are configured in opposing relationship such that the first end 106*a* of the first U-shaped cable trace portion 114*a* is joined to a first flex film card edge connector portion 102*a* of at least a first flex film card edge connector 102 and the first end 106*b* of the second U-shaped cable trace portion 114*b* is joined to a second flex film card edge connector portion 102*b* of the first flex film card edge connector 102. Similarly, the second end 110*a* of the first U-shaped cable trace portion 114*a* is joined to a first flex film card edge connector portion 108*a* and the second end 110*b* of the second U-shaped cable trace portion 114*b* is joined to a second flex film card edge connector portion 108*b* of a second flex film card edge connector 108. Intermediate connector portions 102*c* and 108*c* of the flexible film 106 form spans between the first and second connector portions 102*a* and 102*b* and between the first and second connector portions 108*a* and 108*b*, respectively. The first connector 102 is initially joined to the second connector 108 at a temporary joint 112 formed such that the first, intermediate, and second connector portions 102*a*, 102*c*, and 102*b* are symmetrically disposed in a mirror-image configuration with respect to the first, intermediate, and second connector portions 108*a*, 108*c*, and 108*b*, respectively.

The first and second U-shaped first and second cable trace portions 114*a* and 114*b* may both include a first and a second set of cable traces 104*a* and 104*b*, respectively, disposed upon the first and second cable trace portions 114*a* and 114*b*, respectively, on the first or outer side 117 of the flexible film 106. The cable traces 104*a* and 104*b* may be made from a conductive printing, copper tape or other suitable electrically conductive material.

The first and second flex film card edge connector portions 102*a*, 108*a*, and 102*b*, 108*b*, respectively, may include first and second sets of electrically conductive contact pads 116*a*, 118*a* and 116*b*, 118*b*, disposed upon the first and second connector portions 102*a*, 108*a*, and 102*b*, 108*b*, respectively, also on the first or outer side 117 of the flexible film 106. At least one pad of the first sets of electrically conductive pads 116*a*, 118*a* on the first connector portions 102*a*, 108*a* is electrically coupled to at least one cable trace of the cable traces 104*a*, while at least one pad of the second sets of electrically conductive pads 116*b*, 118*b* on the second connector portions 102*b*, 108*b* is electrically coupled to at least one cable trace of the cable traces 104*b*.

Referring to FIGS. 2-5, the flex film cable assembly 100 further includes at least one of first and second substantially planar substrates or fillers 120 and 121 having at least first and second opposite major surfaces 120*a* and 120*b*, and 121*a* and 121*b*, respectively. The substrates 120 and 121 also have a generally round or blunt leading edge 122 and 123, respectively. The substrates 120 and 121 may be made from a rigid filler material such as a glass-reinforced epoxy with a fire retardant grade FR4 (sold under the trade name Acculam™ by K-Mac Plastics, Wyoming, Michigan, USA).

The second or inner side 119 of the flexible film 106 may be disposed or wrapped around the first and second opposite major surfaces 120*a* and 120*b* of the first substrate 120 and around the first and second opposite major surfaces 121*a* and 121*b* of the second substrate 121 such that the first and second connector portions 102*a* and 102*b*, respectively, are disposed in opposing relationship with respect to one another on the first substrate 120, and the first and second connector portions 108*a* and 108*b*, respectively, are disposed in opposing relationship with respect to one another on the second substrate 121.

Figure 5:
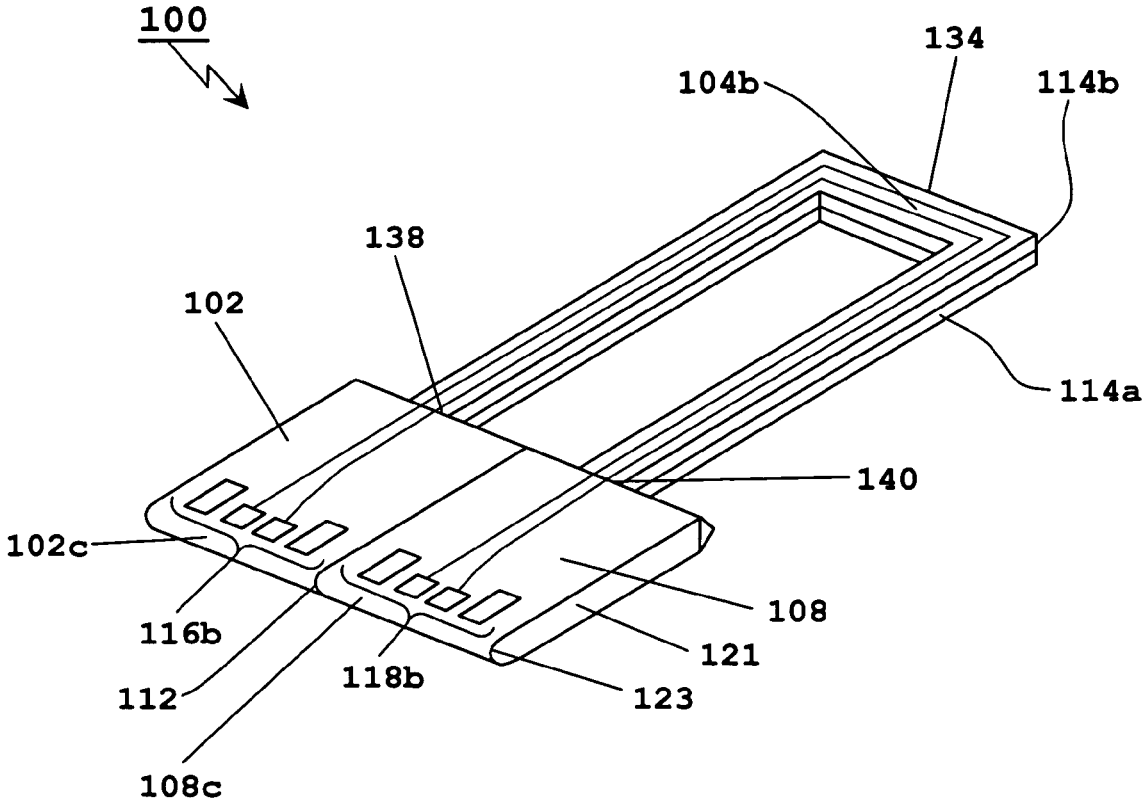
FIG. 5 is a perspective view of the exterior of the cable assembly including a pair of flex film card edge connectors after still further partial assembly.

Furthermore, at least one of the intermediate portions 102*c* and 108*c* of the first and second connectors 102 and 108 span the leading edges 122 and 123 such that the first and second connector portions 102*a* and 102*b*, respectively, are disposed in opposing relationship with respect to one another on the first filler 120, and the first and second connector portions 108*a* and 108*b*, respectively, are disposed in opposing relationship with respect to one another on the second filler 121. The flexible film 106 is wrapped around the leading edges 122 and 123 and is supported on both of the major surfaces 120*a*, 120*b* and 121*a*, 121*b*, respectively, and, as illustrated in FIG. 5, a common end 134 is formed by the overlapping of the generally U-shaped cable trace portions 114*a* and 114*b* configured as an elongated loop.

Figure 1A:
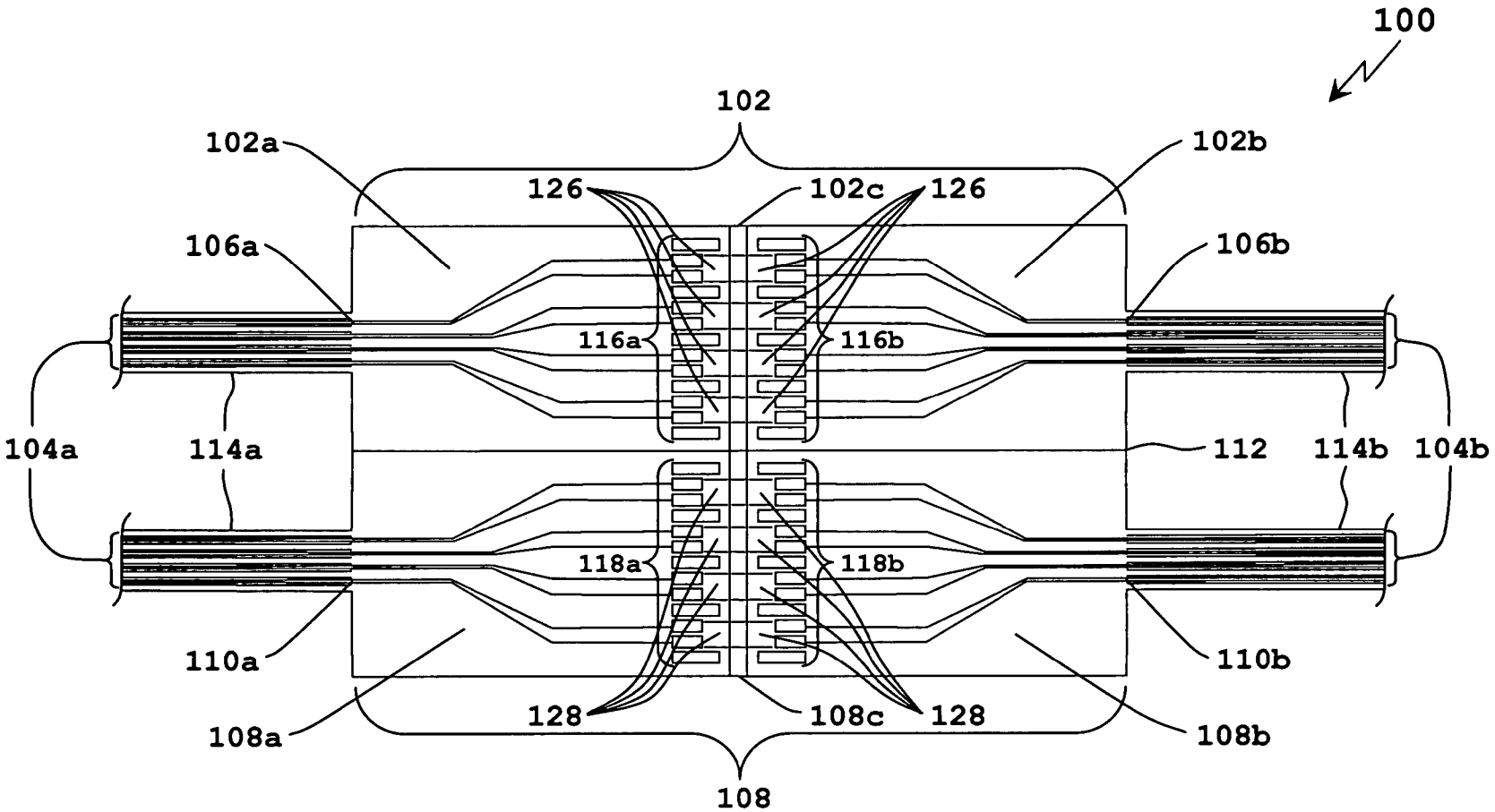
FIG. 1A is a detailed view of a portion of the flex film cable assembly of FIG. 1 illustrating a span between sets of electrically conductive pads without any electrical connection therebetween.

In one embodiment, as illustrated in FIG. 1A, the first and second sets of electrically conductive pads 116*a*, 118*a* or 116*b*, 118*b* are oriented on the first and second connector portions 102 or 108 such that at least one of the electrically conductive pads 116*a* or 118*a* on the first connector portion 102*a* or 108*a* and at least one of the electrically conductive pads 116*b* or 118*b* on the second connector portion 102*b* or 108*b* are paired to form a region or span 126 or 128 on the surface of the intermediate portion 102*c* or 108*c*, respectively, of the flexible film 106. The first and second sets of electrically conductive pads 116*a*, 118*a* and 116*b*, 118*b* are arrayed along the edges 122 and 123, respectively, on one and the other of the major surfaces 120*a*, 120*b* and 121*a*, 121 *b*, respectively. Thereby, the first set of conductive pads, e.g., 116*a* in one of the connectors, e.g., 102, is electrically connected to the first set of conductive pads, e.g., 118*a*, in the other of the connectors, e.g., 108, by a first set of circuit traces 114*a* on the flexible film 106, and the second set of conductive pads, e.g., 116*b*, in the one connector, e.g., 102, is electrically connected to the second set of conductive pads, e.g., 118*b*, in the other connector 108 by a second set of circuit traces 114*b* on the flexible film 106.

The span or region 126 or 128 may be formed of a smooth surface so as to reduce wear of the contacts of the receptacle (not shown) with which the flex film card edge connector 106 interfaces.

In the embodiment of the cable assembly 100 illustrated in FIG. 1A, the entire surface of the intermediate portions 102*c* or 108*c* may be formed of a smooth surface. Thereby, the span 126 or 128 extends around the edge 122 or 123, respectively, without any electrical connection between the first and second sets of electrically conductive pads 116*a*, 118*a* and 116*b*, 118*b*, respectively.

Figure 1B:
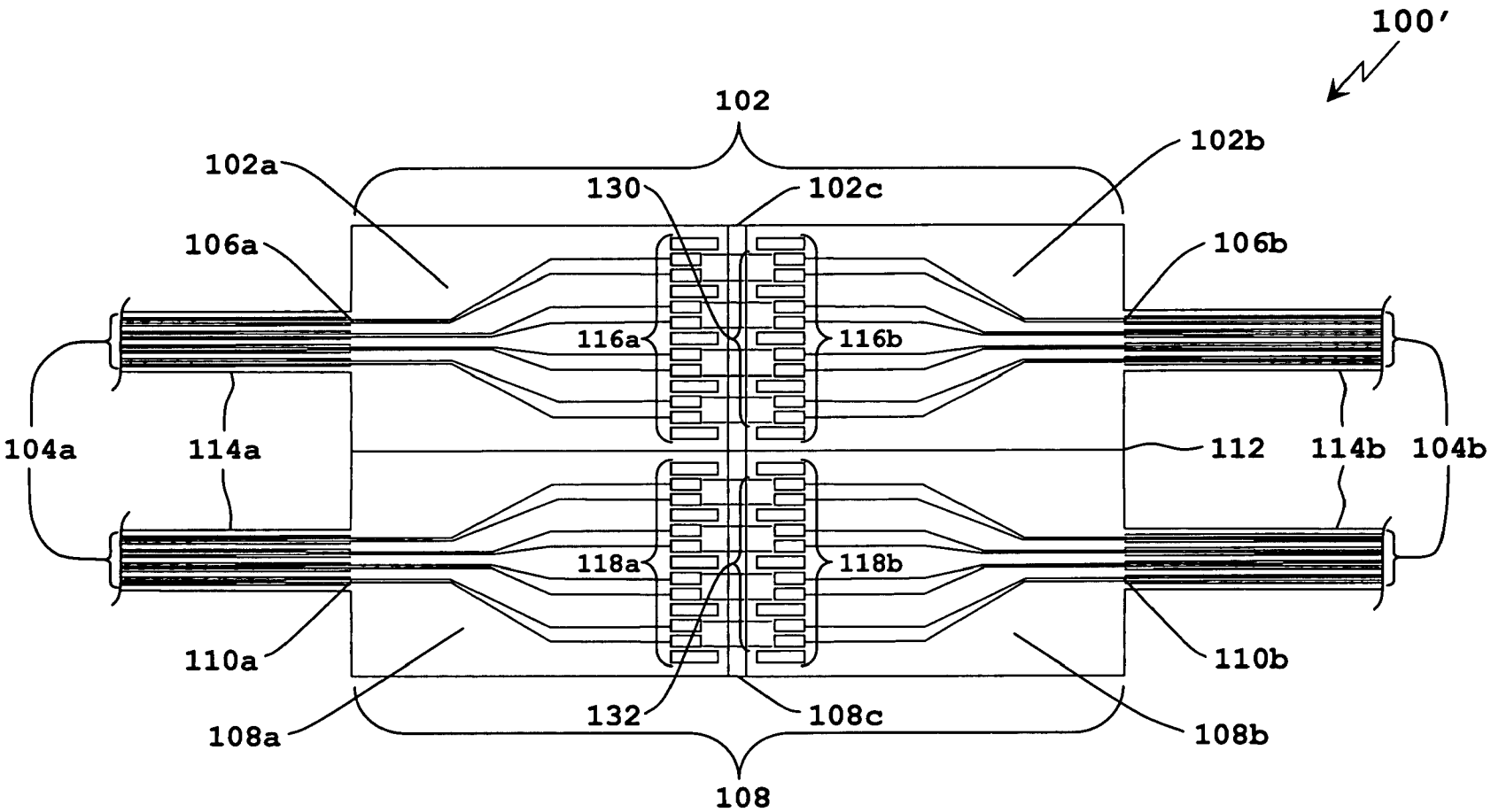
FIG. 1B is a detailed view of a variation of the embodiment of a flex film cable assembly of FIG. 1 illustrating a span having circuit traces between sets of electrically conductive pads.
Figure 2:
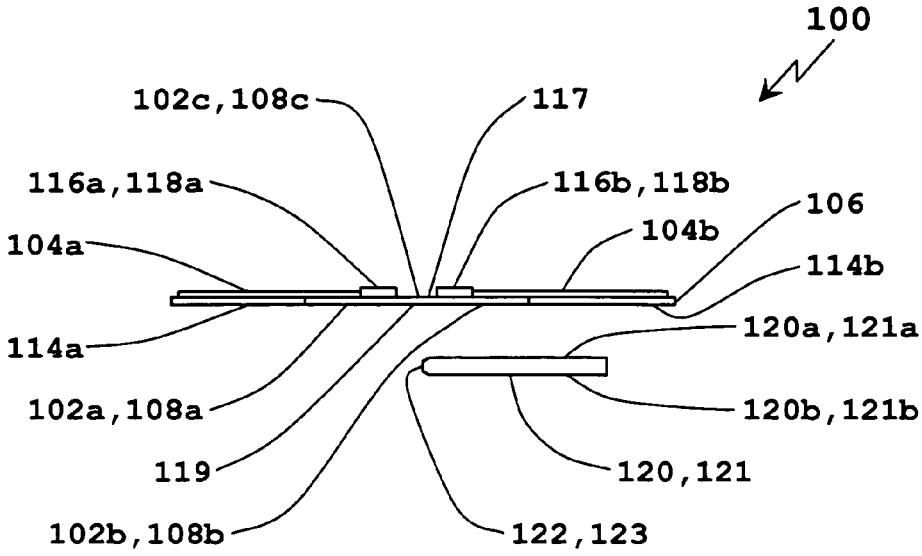
FIG. 2 is an exploded elevation view of the flex film cable assembly of FIG. 1 prior to assembly with a substrate.
Figure 3:
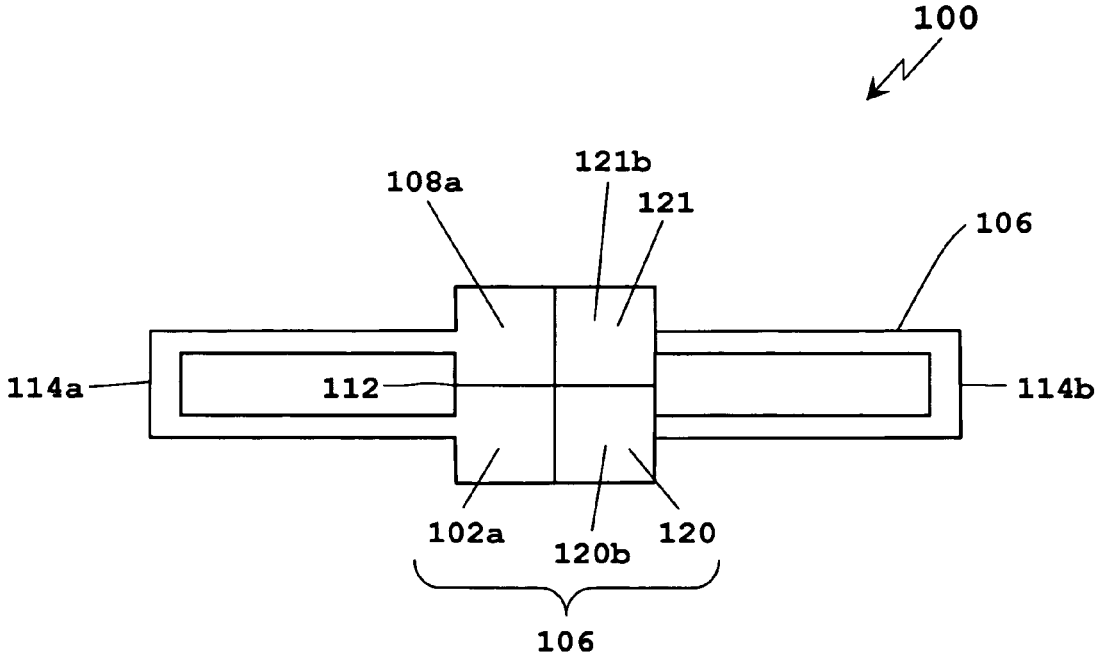
FIG. 3 is a bottom plan view of the flex film cable assembly of FIG. 1 with a substrate disposed at an intermediate manufacturing step.
Figure 4:
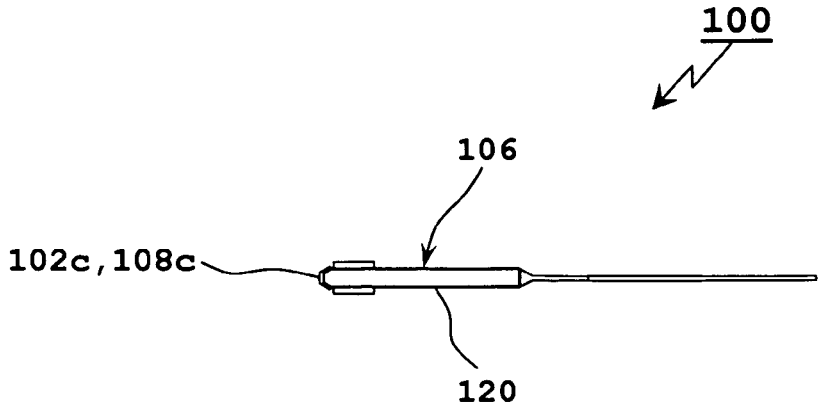
FIG. 4 is an elevation view of the cable assembly with the substrate of FIG. 2 after partial assembly.

In one embodiment, as illustrated in FIG. 1B, flex film cable assembly 100' is identical to flex film cable assembly 100 with the exception that at least one of the first set of contact pads 116*a* or 118*a* on the first connector portion 102*a* or 108*a* and at least one of the second set of contact pads 116*b* or 118*b* on the second connector portion 102*b* or 108*b* are electrically coupled via a circuit trace 130 or 132 extending around the intermediate portions 102*c* or 108*c*, respectively.

Figure 6:
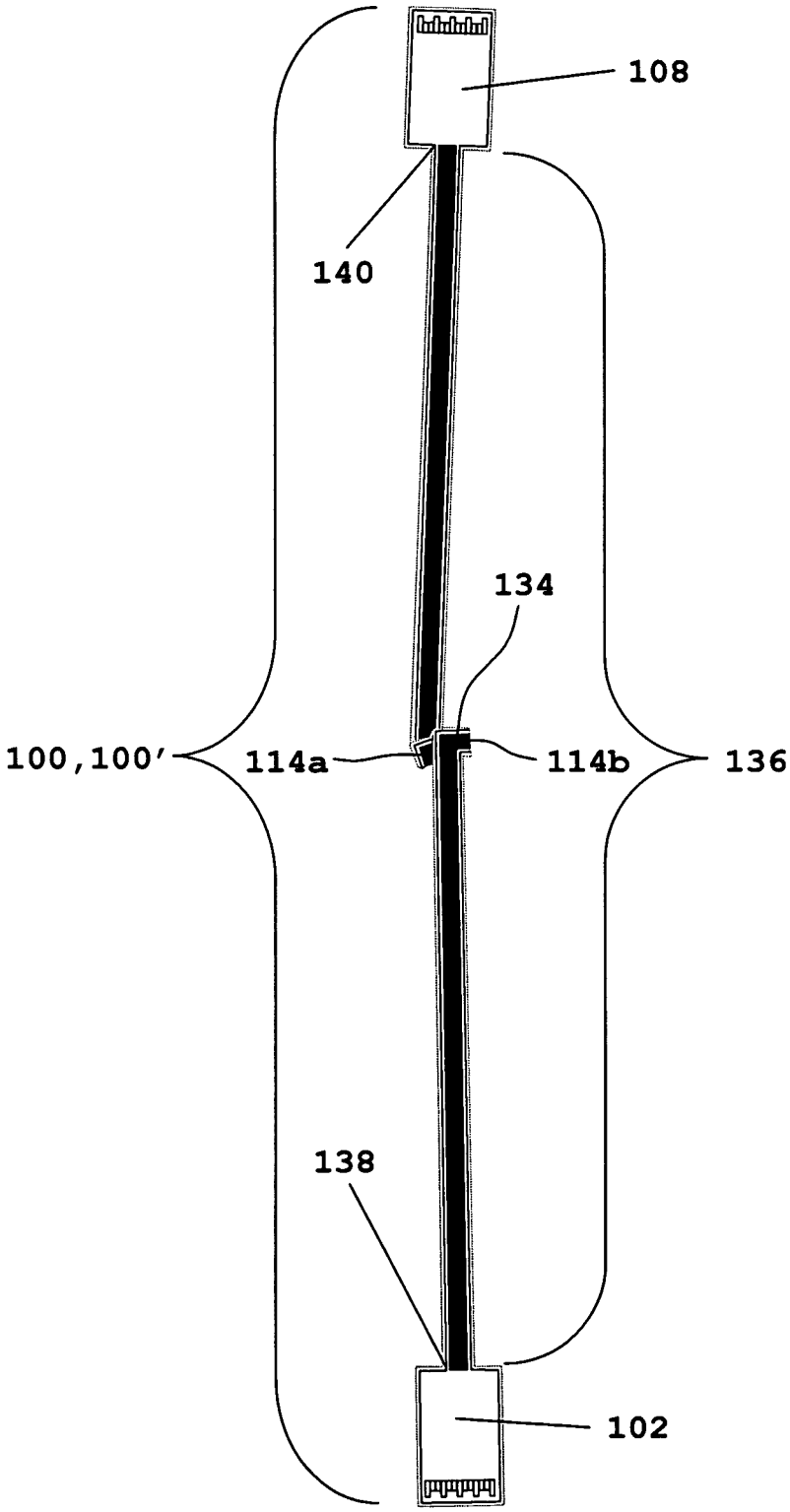
FIG. 6 is a plan view of the cable assembly including the pair of flex film card edge connectors in an extended configuration.

FIG. 6 illustrates the flex film cable assembly 100 or 100' in a final configuration. More particularly, as illustrated in FIG. 5, the flex film card edge connectors 102 and 108 are separated at the temporary joint 112 between the flex film card edge connectors 102 and 108. As illustrated in FIG. 6, the connectors 102 and 108 are then moved with respect to, and away from, each other to form the cable assembly 100 or 100'. The elongated loop formed by the generally U-shaped cable trace portions 114*a* and 114*b* is thereby twisted or moved around the common end 134 to form an elongated strip 136 having first and second ends 138 and 140, respectively. The first end 138 is formed by the intersection of the now overlapping first and second cable trace portions 114*a* and 114*b* with the first flex film card edge connector 102, while the second end 140 is formed by the intersection of the now overlapping first and second cable trace portions 114*a* and 114*b* with the second flex film card edge connector 108.

Figure 7A:
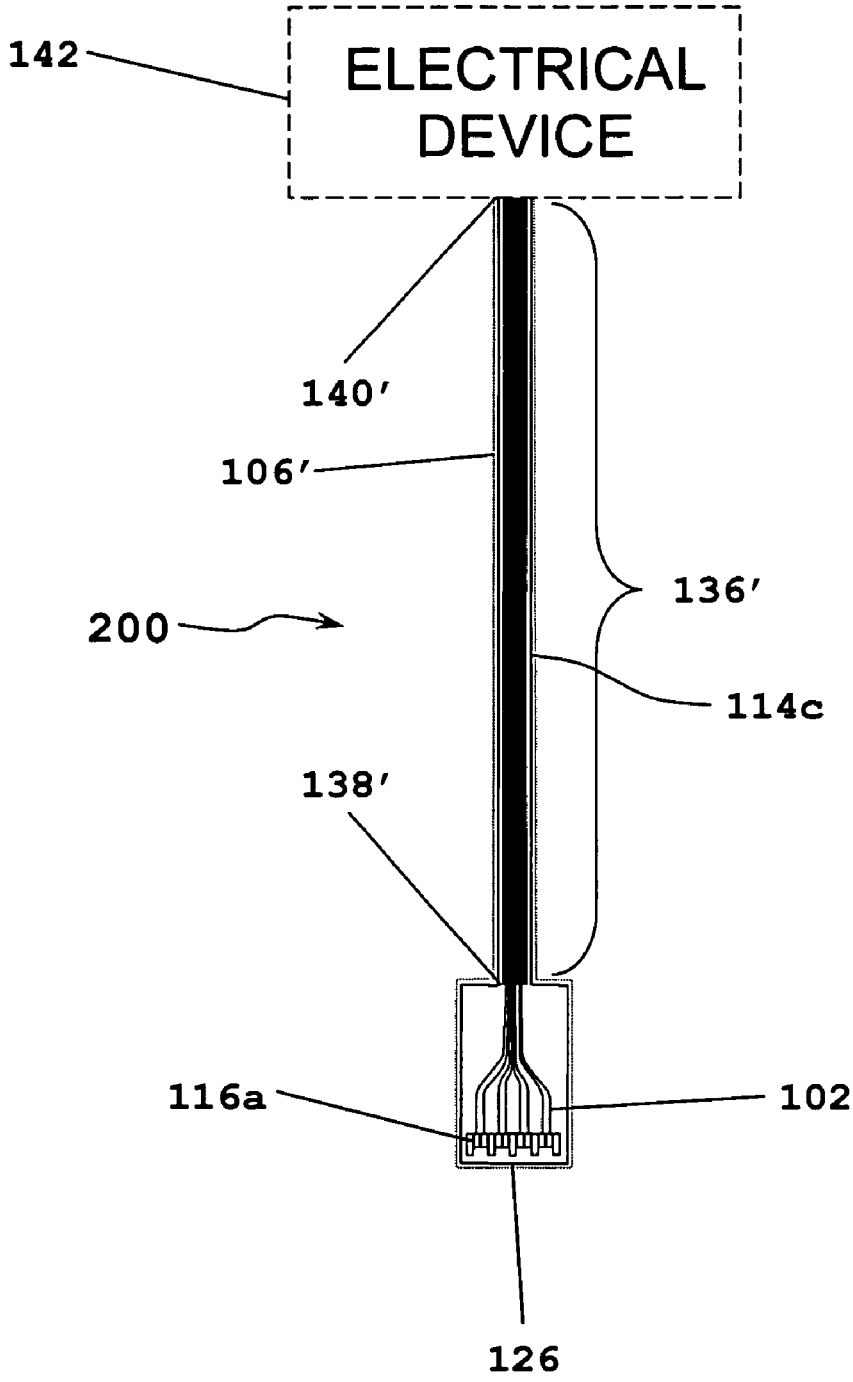
FIG. 7A is a plan view of one side of a cable assembly including a single flex film card edge connector in an extended configuration.
Figure 7B:
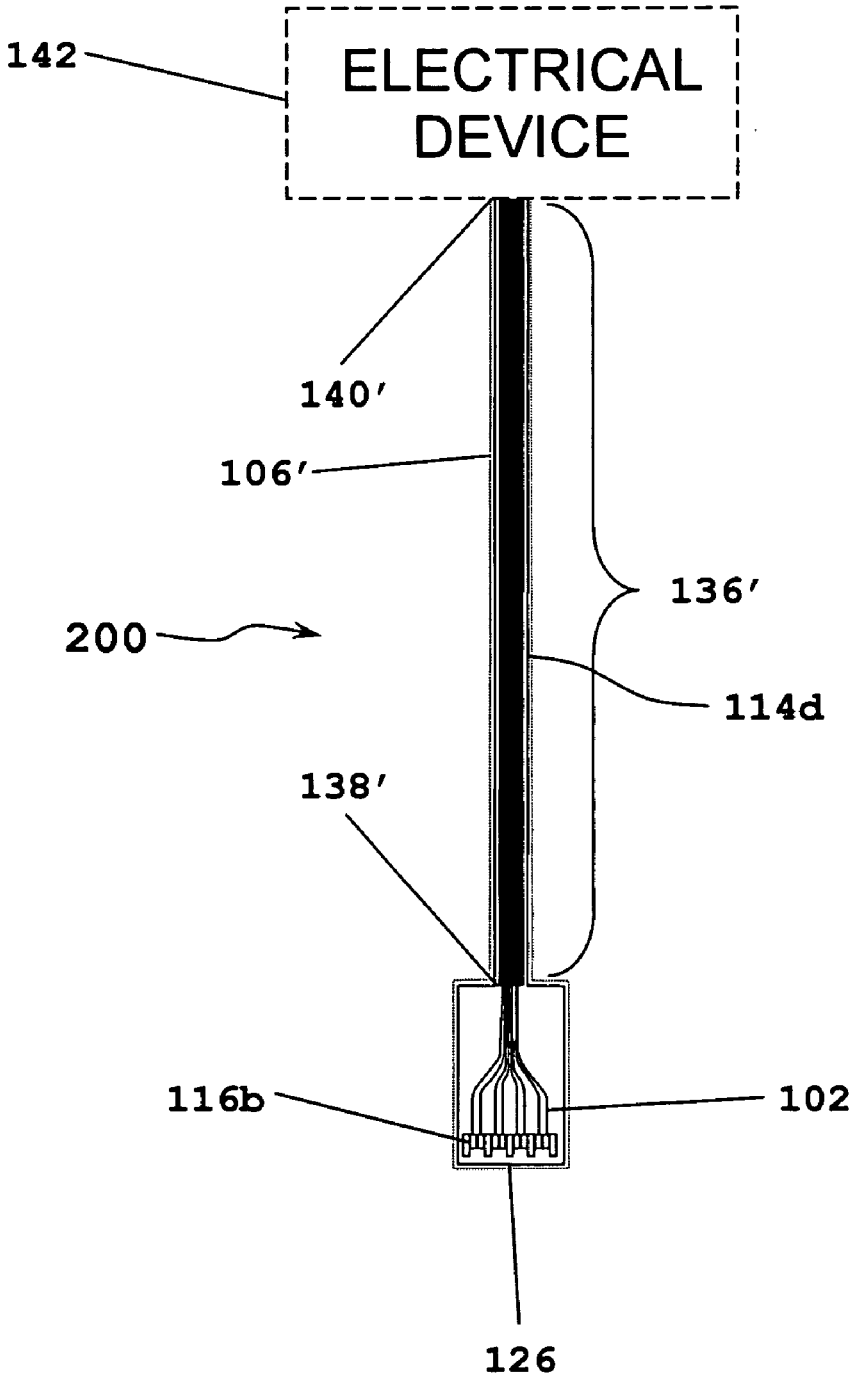
FIG. 7B is a plan view of an opposite side of the cable assembly of FIG. 7A.

FIGS. 7A and 7B illustrate another embodiment of the flex film cable assembly 100 or 100'. More particularly, flex film cable assembly 200 is identical to flex film cable assembly 100 or 100', with the exception that only a single flex film card edge connector 102 is formed at a first end 138' of a flexible film 106' configured as an elongated strip 136'. Further, on one side of the flexible film 106', the first set of electrically conductive pads 116*a* is electrically coupled or connected to a cable trace portion 114*c* at the first end 138'. Similarly, on an opposite side of the flexible film 106', the second set of electrically conductive pads 116*b* is electrically coupled or connected to a cable trace portion 114*d*, thereby forming the cable assembly 200. A second end 140', common to the cable trace portions 114*c* and 114*d*, is now a free end which may be electrically coupled to an electrical device 142 such as, but not limited to, a circuit board or an electrical component, instead of to another flex film card edge connector.

The present disclosure relates also to a method of manufacturing the flex film card edge connector 102 (and 108). More particularly, also referring to FIGS. 1, 1A-1B, 2-6 and 7A-7B, the method includes the steps of providing the flexible film 106 and the substantially planar substrate 120 (121) having opposite major surfaces 120*a* and 120*b* (121*a* and 121*b*) joined at an edge 122 (or 123) and arraying a first set of conductive pads 116*a* (118*a*) along the edge 122 (123) on one of the major surfaces 120*a* (121*a*) and a second set of conductive pads 116*b* (118*b*) along the edge 122 (123) on the other of the major surfaces 120*b* (121*b*). The method also includes the steps of wrapping the flexible film 106 (or 106' of cable assembly 200) around the edge 122 (123) and supporting the flexible film 106 (or 106') on both of the major surfaces 120*a* and 120*b* (121*a* and 121*b*), respectively. The flexible film 106 (or 106') has a span 126 (128) that extends around the edge 122 (123) without any electrical connection between the first set of conductive pads 116*a* (118*a*) and the second set of conductive pads 116*b* (118*b*), respectively.

Referring again to FIGS. 1, 1A-1B, 2-6, and 7A-7B, the present disclosure relates as well to a method of manufacturing flex film cable assembly 100 or 100' (or 200) including the steps of providing the flexible film 106 (or 106' of cable assembly 200) configured as an elongated strip 136 (or 136') having first and second ends 138 and 140 (or 138' and 140') and at least one substantially planar substrate 120, 121 having opposite major surfaces 120*a*, 120*b* and 121*a*, 121*b*, respectively, joined at edge 120 (and 121), and arraying a first set of conductive pads 116*a* (and 118*a*) along the edge 122 (and 123) on one of the major surfaces 120*a* (and 121*a*) and a second set of conductive pads 116*b* (and 118*b*) along the edge 122 (and 123) on the other of the major surfaces 120*b* (and 121*b*).

The method of manufacturing the flex film cable assembly 100 or 100' (or 200) also includes the steps of electrically connecting the first set of conductive pads 116*a* (and 118*a*) in one of the connectors 102 (and 108) to the first set of conductive pads 118*a* (and 116*a*) in the other of the connectors 108 (and 102) by a first set of circuit traces 114*a* (or 114*c*) on the flexible film 106 (or 106'), and electrically connecting the second set of conductive pads 116*b* (and 118*b*) in the one connector 102 (and 108) to the second set of conductive pads 118*b* (and 116*b*) in the other connector 108 (and 102) by a second set of circuit traces 114*b* (or 114*d*) on the flexible film 106 (or 106').

The method of manufacturing the flex film cable assembly 100 or 100' (or 200) further includes the steps of wrapping the flexible film 106 (or 106') around the edge 122 (and 123), and supporting the flexible film 106 (or 106') on both of the major surfaces 120*a* and 120*b* (and 121*a* and 121*b*), respectively. The flexible film 106 (or 106') has a span 126 (and 128) that extends around the edge 122 (and 123) without any electrical connection between the first set of conductive pads 116*a* (and 118*a*) and the second set of conductive pads 116*b* (and 118*b*), to form a flex film card edge connector 102 (and 108) at the first end 138 (or 138') of the elongated strip 136 (or 136'). The second end 140 (or 140') of the elongated strip 136 (136') may be a free end.

Alternatively, with respect to flex film cable assembly 100 or 100', the elongated strip 136 may be an elongated loop having first and second ends 138 and 140, and the step of providing may be performed by providing at least two substantially planar substrates 120 and 121. Each substrate 120 and 121 has opposite major surfaces 120*a*, 121*a* and 120*b*, 121 joined at an edge 122 and 123, respectively, and the steps of arraying, wrapping and supporting are implemented to form at least two flex film card edge connectors 102 and 108 joined at joint 112 such that each of the at least two flex film card edge connectors 102 and 108 has span 126 and 128 that extends around the edge 122, 123 without any electrical connection between the first set of conductive pads 116*a*, 118*a* and the second set of conductive pads 116*b*, 118*b*, respectively.

As previously described with respect to FIG. 6, the method of manufacturing the flex film cable assembly 100 or 100' may further include the steps of separating the flex film card edge connectors 102 and 108 at the joint 112, and moving one of the card edge connectors 102 or 108 with respect to another one of the card edge connectors 108 or 102 to form the cable assembly 100 or 100'.

Referring to FIG. 7, those skilled in the art will recognize that, and understand how, the flex film cable assembly 200 can be manufactured to yield the elongated strip 136' and the single flex film card edge connector 102.

It can be seen therefore that the flexible film cable assembly 100 is configured with at least one flex film card edge connector 102 and, in the case of flex film cable assemblies 100 and 100', may also include at least a second flex film card edge connector 108 that provides a span 126 (and 128) that extends around the edge 120 (and 121) without any electrical connection between the first set of conductive pads 116*a* (and 118*a*) and the second set of conductive pads 116*b* (and 118*b*).

The described embodiments of the present disclosure are intended to be illustrative rather than restrictive, and are not intended to represent every embodiment of the present disclosure. Various modifications and variations can be made without departing from the spirit or scope of the disclosure as set forth in the following claims both literally and in equivalents recognized in law.

What is claimed is:

1. A method of making a cable assembly, comprising the steps of:

providing a length of flexible film having a mid-portion comprising a first set of conductive pads side-by-side with a second set of conductive pads, a first set of circuit traces on the flexible film arranged in a U-shape and connecting a first portion of the first set of conductive pads to a first portion of the second set of conductive pads, and a second set of circuit traces on the flexible film arranged in a U-shape and connecting a second portion of the first set of conductive pads to a second portion of the second set of conductive pads;

providing a substrate having opposite major surfaces joined by an edge;

wrapping the flexible film around the edge of the substrate such that both the first portion of the first set of conductive pads and the first portion of the second set of conductive pads are disposed on one of the major surfaces of the substrate, and both the second portion of the first set of conductive pads and the second portion of the second set of conductive pads are disposed on the other major surface of the substrate;

severing the substrate and the flexible film in an area between the first and second sets of conductive pads, thereby forming first and second connectors; and separating the first and second connectors from each other, thereby forming a cable assembly having the first connector at one end and the second connector at an opposite end.

2. A cable assembly made by the steps of:

providing a length of flexible film having a mid-portion comprising a first set of conductive pads side-by-side with a second set of conductive pads, a first set of circuit traces on the flexible film arranged in a U-shape and connecting a first portion of the first set of conductive pads to a first portion of the second set of conductive pads, and a second set of circuit traces on the flexible film arranged in a U-shape and connecting a second portion of the first set of conductive pads to a second portion of the second set of conductive pads;

providing a substrate having opposite major surfaces joined by an edge;

wrapping the flexible film around the edge of the substrate such that both the first portion of the first set of conductive pads and the first portion of the second set of conductive pads are disposed on one of the major surfaces of the substrate, and both the second portion of the first set of conductive pads and the second portion of the second set of conductive pads are disposed on the other major surface of the substrate;

severing the substrate and the flexible film in an area between the first and second sets of conductive pads, thereby forming first and second connectors; and separating the first and second connectors from each other, thereby forming a cable assembly having the first connector at one end and the second connector at an opposite end.

* * * * *